US011352969B2

(12) United States Patent
Koo

(10) Patent No.: US 11,352,969 B2
(45) Date of Patent: Jun. 7, 2022

(54) COLD START SPLIT INJECTION CONTROL METHOD AND ENGINE SYSTEM

(71) Applicants: Hyundai Motor Company, Seoul (KR); Kia Motors Corporation, Seoul (KR)

(72) Inventor: Bon-Chang Koo, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 93 days.

(21) Appl. No.: 16/842,271

(22) Filed: Apr. 7, 2020

(65) Prior Publication Data

US 2021/0239059 A1 Aug. 5, 2021

(30) Foreign Application Priority Data

Feb. 4, 2020 (KR) ..... 10-2020-0013203

(51) Int. Cl.

| | |
|---|---|
| ***F02D 41/06*** | (2006.01) |
| ***F02D 41/40*** | (2006.01) |
| *F02D 41/30* | (2006.01) |
| *F02D 41/38* | (2006.01) |

(52) U.S. Cl.

CPC ..... *F02D 41/064* (2013.01); *F02D 41/402* (2013.01); *F02D 41/3094* (2013.01); *F02D 41/401* (2013.01); *F02D 2041/389* (2013.01); *F02D 2200/021* (2013.01); *F02D 2200/0602* (2013.01)

(58) Field of Classification Search

CPC ..... F02D 2041/2055; F02D 2041/2058; F02D 2041/389; F02D 2200/021; F02D 2200/0602; F02D 2200/101; F02D 41/064; F02D 41/221; F02D 41/3094; F02D 41/401; F02D 41/402

See application file for complete search history.

(56) References Cited

U.S. PATENT DOCUMENTS

| | | | | |
|---|---|---|---|---|
| 10,161,340 | B1 * | 12/2018 | Lucido | F02D 41/1405 |
| 2004/0040541 | A1 * | 3/2004 | Goto | F02D 41/402 123/445 |
| 2004/0118384 | A1 * | 6/2004 | Oyama | F02D 41/3082 123/479 |
| 2011/0184629 | A1 * | 7/2011 | Krengel | F02D 41/3076 701/103 |
| 2011/0209685 | A1 * | 9/2011 | Shane | F02D 41/064 123/299 |
| 2013/0218441 | A1 * | 8/2013 | Thomas | F02D 41/0002 701/105 |
| 2018/0230928 | A1 * | 8/2018 | Kitazume | F02D 41/064 |
| 2020/0088123 | A1 * | 3/2020 | Itaba | F02M 61/04 |

FOREIGN PATENT DOCUMENTS

KR 1994-0011775 6/1994

* cited by examiner

*Primary Examiner* — Carl C Staubach
(74) *Attorney, Agent, or Firm* — Fox Rothschild LLP

(57) ABSTRACT

A cold start split injection control method is provided. The method includes a split injection controller which determines cold start conditions of an engine system, an injection mode control which performs a cold start split injection by an operation of an injector and an injection malfunction diagnostic control which performs an injection malfunction diagnostic with any one or more among an injector opening angle, an injector operating time, and the number of injector operation times which are measured through the fuel injection of the injector.

16 Claims, 9 Drawing Sheets

COLD START SPLIT INJECTION CONTROL METHOD AND ENGINE SYSTEM

CROSS-REFERENCE TO RELATED APPLICATION

This application claims priority to Korean Patent Application No. 10-2020-0013203, filed on Feb. 4, 2020, which is incorporated herein by reference in its entirety.

BACKGROUND

Field of the Disclosure

The present disclosure relates to a cold start split injection control, and more particularly, to an engine system, which performs a malfunction diagnostic for an injector operation of each of triple split injection which is applied in a triple injection pattern upon cold start, thereby implementing a split injection control for reducing an emission under cold start operation conditions.

Description of Related Art

Generally, an ignition timing control, a fuel amount control, a continuously variable valve timing (CVVT) control, and the like are applied to an engine, thereby contributing to reducing a cold start emission which is generated from a vehicle. Particularly, a split injection control upon the start of two or more times which is performed upon engine start contributes to enhancing combustion stability and emission reduction performance of the engine.

Furthermore, the split injection control upon cold start extends the effects of enhancing the combustion stability and emission reduction performance of the engine to a cold start region of the engine which has not been applied conventionally, and thus is adopted as a response strategy to tightening emission regulations of the vehicle.

The contents described in this section are merely to help the understanding of the background of the present disclosure, and may include what is not previously known to those skilled in the art to which the present disclosure pertains.

However, for the cold start split injection control to be newly applied to the vehicle, it is necessary to meet "malfunction diagnostic obligation regulations on control used upon cold start" of the CARB OBD-2 section 1968.2 in the North American Law and "regulations on triple fuel injections or homogeneous injection (triple)" in the injection mode upon cold start in the North American AECD documents. In particular, the AECD refers to an auxiliary emission control device. Accordingly, for the split injection control upon cold start to be applied to the vehicle, the regulations regarding the malfunction diagnostic of the control used upon cold start and triple or more split injections in the injection mode should be met first.

SUMMARY

Accordingly, an object of the present disclosure is to provide a cold start split injection control method and an engine system, which may meet the injection mode regulation under the split injection control which is implemented in the triple injection pattern upon cold start of the engine, may meet the malfunction diagnostic regulation of the control upon cold start by performing the malfunction diagnostic determination by using the number of split injection times, an injection time, and an injection angle which are measured from the triple injection patterns, and may respond to tightening the emission regulations by extending the split injection control to the cold start region.

A cold start split injection control method according to the present disclosure for achieving the object may include, by a split injection controller which detects cold start conditions of an engine system, an injection mode control which performs a cold start split injection by an operation of an injector and an injection malfunction diagnostic control which performs an injection malfunction diagnostic with any one or more among an injector opening angle, an injector operating time, and the number of injector operation times which are measured through the fuel injection of the injector.

As an exemplary embodiment, the cold start conditions may be determined as a coolant temperature which is applied as a determination condition by setting a setting coolant temperature to about 56° C., and an engine revolutions per minute (RPM) which is applied as the determination condition by setting a setting engine RPM region to about 700 to 960 revolution per minute (RPM), and the cold start condition determination may be performed based on the coolant temperature firstly followed by the engine RPM. Additionally, the injection mode control may be configured to generate, as injection operation detection values, any one or more among an injector opening angle, an injector closing angle, an injector operating time, and the number of injector operation times by performing the cold start split injection.

The injection mode control may be performed by determining operating current inflection points by detecting injector operating currents based on a fuel injection start, measuring an injector opening time point and an injector opening angle, determining operating voltage inflection points by detecting injector operating voltages based on the fuel injection start, measuring an injector closing time point and an injector closing angle based on a fuel injection termination, calculating an injector operating time, and counting the number of injector operation times.

Particularly, the injector operating time may be calculated by the difference between the injector closing time point and the injector opening time point. The injection mode control may be performed by a first injection mode, a second injection mode, and a third injection mode in which the number of injector operation times is increased by a count of 1.

The injection malfunction diagnostic control may be performed by confirming a target injector opening angle, a target injector closing angle, a target injector operating time, and the number of target injector operation times, determining a time verification of the injector operating time with the target injector operating time and the injector operating time, determining an angle verification of the injector opening angle with the injector opening angle and the target injector opening angle, and confirming the number of times of the number of injector operation times with the target number of the injector operation times and the number of injector operation times.

Further, the determining of the time verification may include applying a time index estimation value, which is obtained by dividing a difference value of the target injector operating time and the injector operating time by the target injector operating time, and a time index threshold. The time index threshold may be about 0.2; and the cold start split injection may be determined as malfunction in response to determining that the time index estimation value is less than the time index threshold. The determining of the angle verification may include applying an angle index estimation value, which is obtained by dividing a difference value of the target injector opening angle and the injector opening angle by the target injector opening angle, and an angle index threshold. The angle index threshold may be about 0.2 and the cold start split injection may be determined as malfunction in response to determining that the angle index estimation value is less than the angle index threshold.

Additionally, the confirming of the number of times may include applying 3 to the target number of the injector operation times and the number of injector operation times, and determining the cold start split injection as malfunction in response to determining that the number of target injector operation times and the number of injector operation times are not 3.

According to another aspect of the present disclosure, an engine system for achieving the object may include a split injection controller configured to perform a cold start split injection by a triple split injection operation of an injector based on a cold start operation to measure, as operation values, any one or more among an injector opening angle, an injector operating time, and the number of injector operation times, and to read, as verification values, any one or more among a target injector opening angle, a target injector closing angle, a target injector operating time, and the target number of the injector operation times to apply the operation values and the verification values to malfunction determination of the cold start split injection, and an engine warning light configured to output a warning regarding the malfunction determination.

The split injection controller may be configured to determine the conditions of the cold start operation with any one or more of a setting coolant temperature applied to a coolant temperature and a setting engine RPM region applied to an engine RPM. In addition, the split injection controller may include an injector opening determinator configured to detect an operating current inflection point of the injector, an injector closing determinator configured to detect an operating voltage inflection point of the injector, an injector operation detector configured to generate the operation values, an injector operation target determinator configured to generate the verification values, a cold start split injection determinator configured to perform the malfunction determination by applying the operation values and the verification values to any one among the determining of the time verification of the injector operating time, the determining of the angle verification of the injector opening angle, and the confirming of the number of times of the number of injector operation times, and a malfunction determinator configured to output a signal regarding the malfunction determination.

The cold start split injection control which is implemented in the engine system according to the present disclosure implements the following operations and effects.

Firstly, it may be possible to extend the split injection control to the cold start region of the engine, thereby further enhancing the effect of reducing the emission as well as responding to tightening the emission regulations. Secondly, it may be possible for the split injection control to perform triple or more split injections which perform the normal operation diagnostic for each in the triple injection patterns together, thereby meeting the North American Law and the North American AECD document. Thirdly, it may be possible to utilize, as the malfunction diagnostic variables, the number of split injection times, the injection time, and the injection angle which are measured from the triple injection patterns, thereby implementing the malfunction diagnostic determination logic in a simplified manner. Fourthly, it may be possible to enhance the combustion stability and emission reduction performance of the engine by the synergy effects of the ignition timing control, the fuel amount control, the CVVT control, the split injection control upon start, and the split injection control upon cold start, thereby improving the vehicle merchantability.

BRIEF DESCRIPTION OF THE DRAWINGS

The above and other features of the present disclosure will now be described in detail with reference to certain exemplary embodiments thereof illustrated in the accompanying drawings which are given hereinbelow by way of illustration only, and thus are not limitative of the present invention, and wherein.

DETAILED DESCRIPTION

Figure 1A:
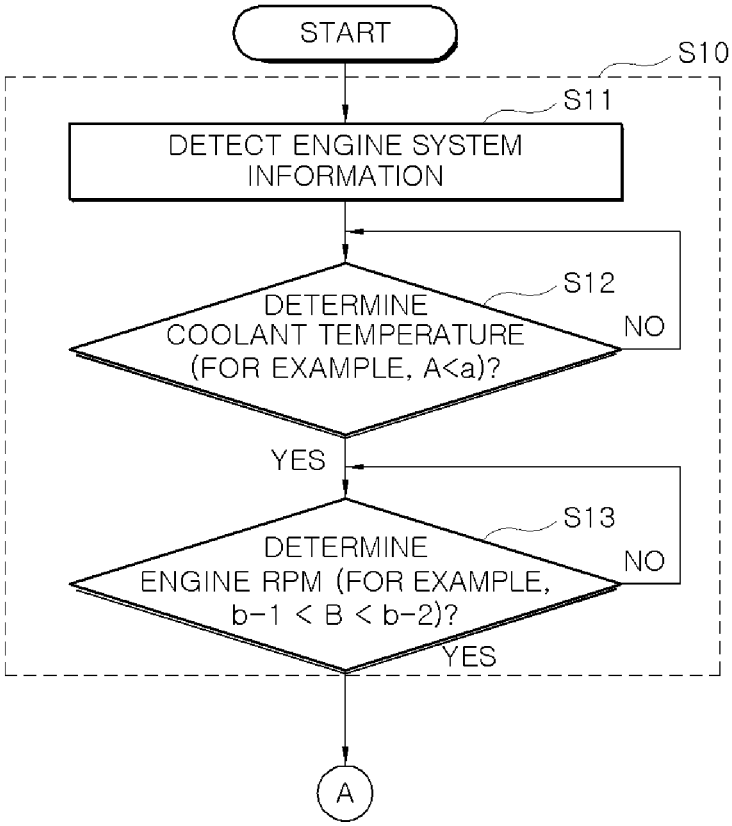
FIGS. 1A, 1B and 1C are a flowchart illustrating a cold start split injection control method according to an exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor. The memory is configured to store the modules and the processor is specifically configured to execute said modules to perform one or more processes which are described further below.

Furthermore, control logic of the present disclosure may be embodied as non-transitory computer readable media on a computer readable medium containing executable program instructions executed by a processor, controller/control unit or the like. Examples of the computer readable mediums include, but are not limited to, ROM, RAM, compact disc (CD)-ROMs, magnetic tapes, floppy disks, flash drives, smart cards and optical data storage devices. The computer readable recording medium can also be distributed in network coupled computer systems so that the computer readable media is stored and executed in a distributed fashion, e.g., by a telematics server or a Controller Area Network (CAN).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, exemplary embodiments of the present disclosure will be described in detail with reference to the exemplary accompanying drawings, and since these exemplary embodiments, as examples, may be implemented in various different forms by those skilled in the art to which the present disclosure pertains, they are not limited to the exemplary embodiments described herein.

Figure 1B:
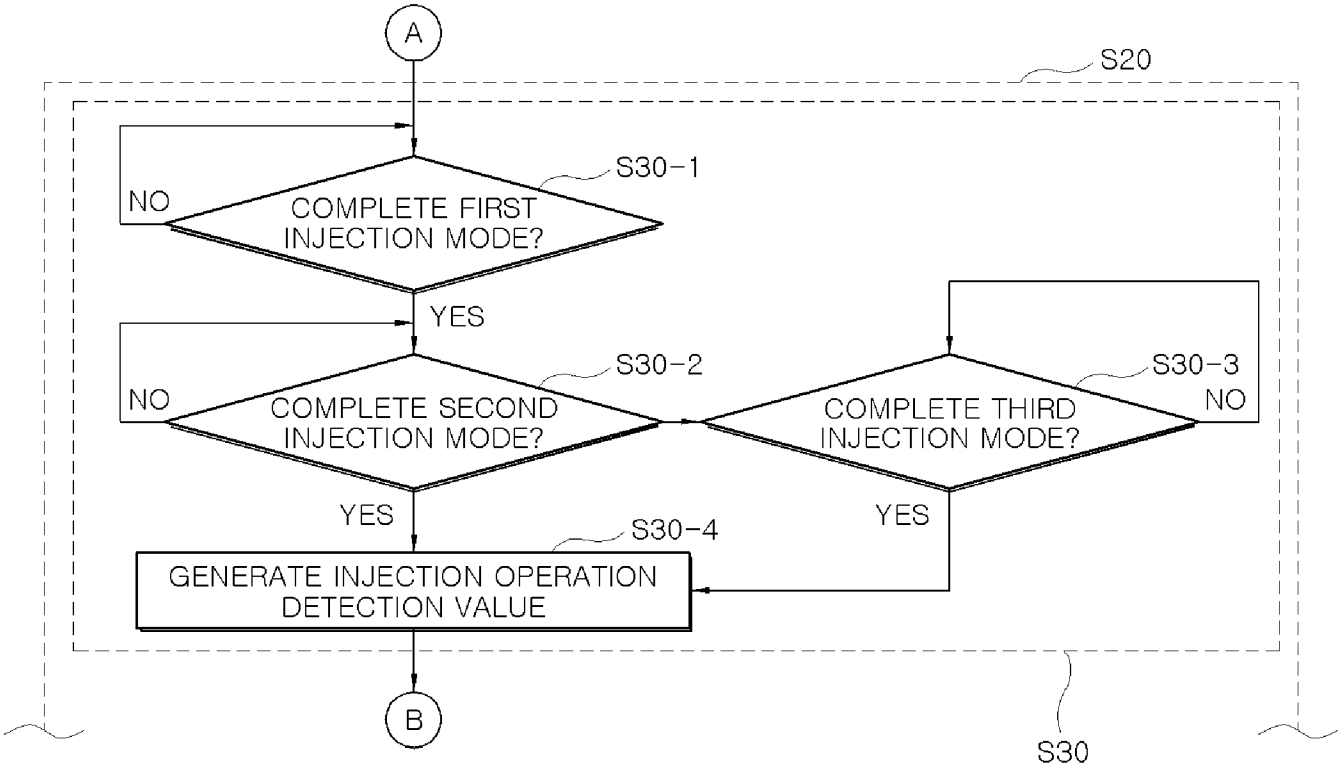
Figure 1C:
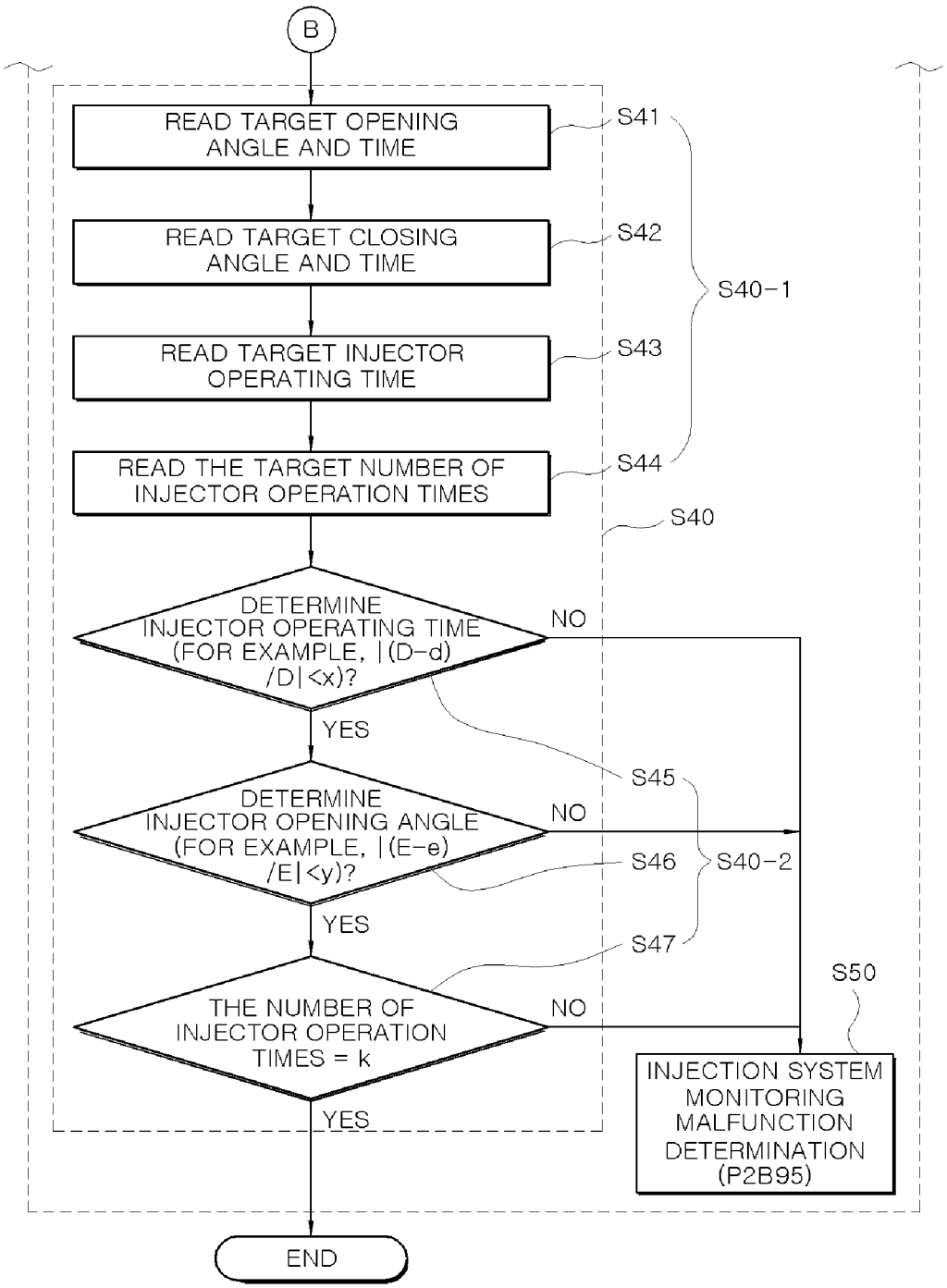

Referring to FIGS. 1A, 1B and 1C, a cold start split injection control method may include performing a cold start determination control which applies, as cold start determination variables, an engine coolant temperature and an engine revolution per minute (RPM) (S10) and then performing a cold start split injection control (S20) to meet triple fuel injections (or homogenous injection (triple)) by an injection mode control (S30) and a cold start control malfunction diagnostic by an injection malfunction diagnostic control (S40), thereby meeting the regulations of the North American AECD document required items and CARB OBD-2 section 1968.2.

As a result, the cold start split injection control method may provide notification regarding the occurrence of two or more malfunctions using an engine warning light by monitoring whether to satisfy setting reference values of the number of injection times, an injection time, and an injection angle by using injection signal voltage and current which are measured for each of the injection patterns using the number of split injection times three or more times when the cold start split injection is performed. Accordingly, the cold start split injection control method may reduce an emission upon cold start which may be applied to the engine requiring the split injection upon cold start which enables the malfunction diagnostic determination by measuring the number of split injection times, the injection time, and the injection angle by using the cold start split injection pattern.

Figure 2:
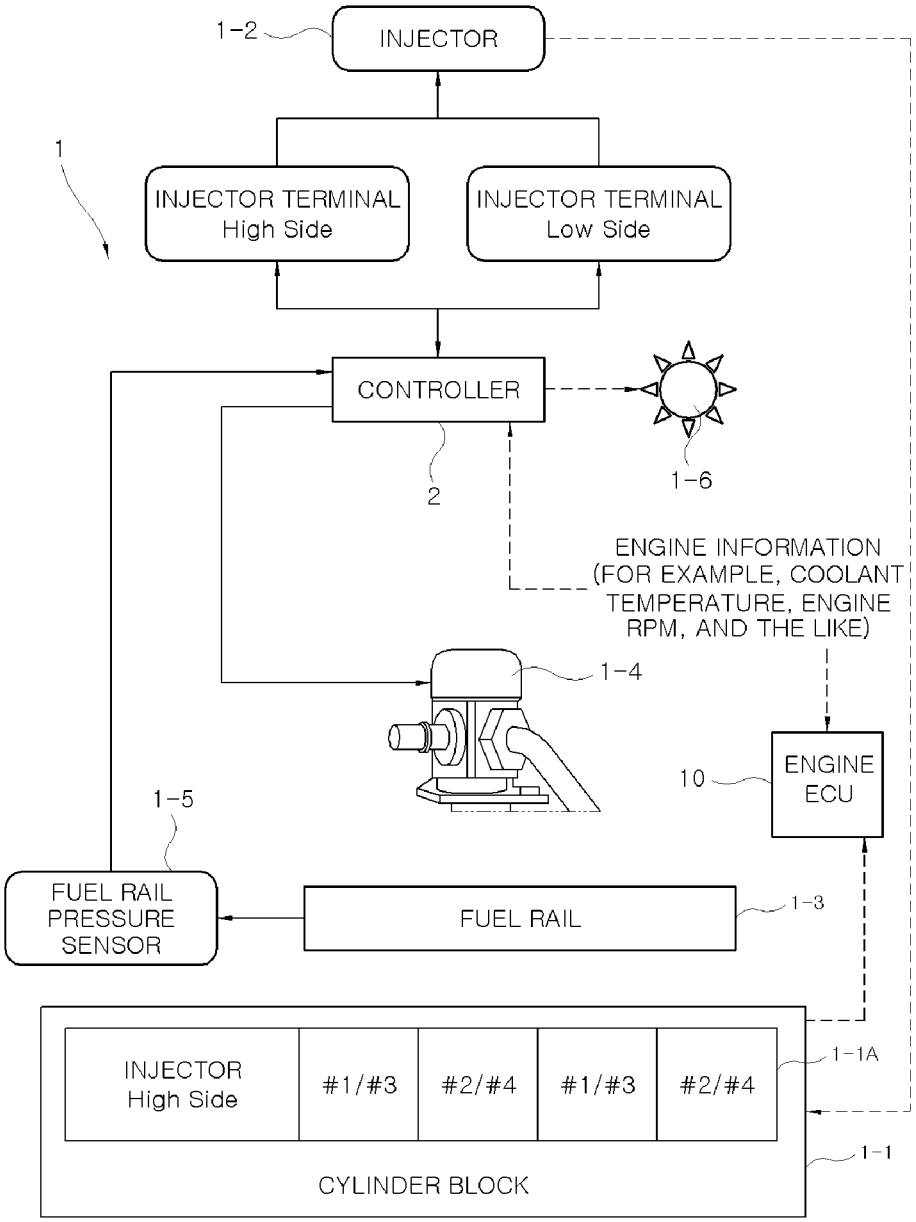
FIG. 2 is a diagram illustrating an example of an engine system in which the cold start split injection control according to an exemplary embodiment of the present disclosure is implemented.

Referring to FIG. 2, an engine system 1 of a vehicle may include an engine 1-1, a plurality of injectors 1-2 installed to a cylinder 1-1A of the engine 1-1, a fuel rail 1-3, a high pressure pump 1-4, a fuel rail pressure sensor 1-5, an engine warning light 1-6, and a split injection controller 2. Specifically, the engine system 1 may be a gasoline direct injection (GDI) engine system configured to supply fuel injected directly to a combustion chamber to a low pressure pump and a high pressure pump.

For example, the injector 1-2 may be configured to inject fuel into the cylinder 1-1A (e.g., 4 cylinders) of the engine 1-1 using the high pressure pump and the low pressure pump; the fuel rail 1-3 may form a transport path of the high pressure fuel; the high pressure fuel pump 1-4 may form, as a high pressure, a rail pressure connected to the injector 1-2 in interlock with a cam knob when a pump driving cam rotates; the fuel rail pressure sensor 1-5 may be configured to detect a fuel injection pressure; and the engine warning lamp 1-6 may be disposed on a cluster of a driver's seat to inform the driver of the split injection malfunction of the injector 1-2. Accordingly, the engine 1-1, the injector 1-2, the fuel rail 1-3, the high pressure pump 1-4, the fuel rail pressure sensor 1-5, and the engine warning light 1-6 are typical components.

Specifically, the split injection controller 2 may be configured to output a pumping pulse and a flow control valve (FCV) driving pulse of the high pressure fuel pump 1-4 and adjust the driving current and voltage of the injector 1-2. The split injection controller 2 includes a memory equipped with a program or an algorithm for the injection mode control (S30)/the injection malfunction diagnostic control (S40)/the malfunction determination (S50) of the cold start determination control (S10) and the cold start split injection control (S20), and may be operated as a central processing unit which implements a logic processing of the program or the algorithm.

In addition, the split injection controller 2 may be connected to an engine electronic control unit (ECU) 10 and a controller area network (CAN) to read, as input data, an coolant temperature and an engine revolution per minute (RPM) which are engine information detected by the engine controller 10. Particularly, as in FIG. 3, the split injection controller 2 may include an injector operation measurer 3, an injector operation detector 4, an injector operation target determinator 5, a cold start split injection determinator 6, and a malfunction determinator 7, and the operation of each of these components is described in detail together with the procedure for each step of the cold start split injection control (S20). The controller may be specifically programmed to operate these components (e.g., control components of the controller).

Hereinafter, a static flow rate learning section extension method using an injector closing sensing time of FIGS. 1A, 1B and 1C are will be described in detail with reference to FIGS. 2 to 6. In particular, the control subject is the split injection controller 2, and the control object is the injector 1-2. First, the split injection controller 2 may be configured to execute the cold start determination control (S10) to detect engine system information (S11), determine a first cold start condition (S12), and determine a second cold start condition (S13).

Referring to FIG. 2, the split injection controller 2 may be configured to detect the engine system information (S11) by reading, as input data, the coolant temperature and the engine RPM among the engine information detected by the engine ECU 10 when the engine 1-1 is started via CAN communication with the engine ECU 10. Subsequently, the split injection controller 2 may be configured sequentially determine the first cold start condition (S12) to which the coolant temperature is applied and determine the second cold start condition (S13) to which the engine RPM is applied.

For example, the determining of the first cold start condition (S12) may include applying a coolant temperature determination expression, and the determining of the second cold start condition (S13) may include applying an engine RPM determination expression:

$A<a?$ Coolant temperature determination expression:

$b-1<B<b-2?$ Engine RPM determination expression:

wherein "A" refers to a current coolant temperature which is detected after the engine is started, and "a" refers to a coolant temperature threshold which satisfies the first cold start condition, and may be specified as 56° C. between about 50 to 60° C. Accordingly, the determining of the first cold start condition (S12) may include applying a coolant temperature value as the determination condition.

In addition, in the above expression, "B" refers to a current engine RPM detected after the engine is started; "b−1" refers to an engine RPM lower threshold which satisfies the second cold start condition, and may be specified as about 700 RPM, and "b−2" refers to an engine RPM upper threshold which satisfies the second cold start condition, and may be specified as 960 RPM between about 900 to 1000 RPM. Accordingly, the determining of the second cold start condition (S13) may include applying the engine RPM region as the determination condition. In addition, "<" refers to an inequality sign indicating the magnitude relationship between two values.

As a result, the split injection controller 2 may return to the detecting of the engine system information (S11) if the condition of "b−1<B<b−2" is not satisfied when the condition of "A<a" is not satisfied or is satisfied to retry the cold start determination but may switch the cold start split injection control to the fuel injection control, if necessary.

On the other hand, the split injection controller 2 may proceed to the cold start split injection control (S20) when determining the cold start state by simultaneously satisfying the first and second cold start conditions when the engine RPM (B) is present in a region between the upper/lower thresholds (b−2, b−1) of the engine RPM at the coolant temperature (A) less than the coolant temperature threshold (a).

Subsequently, the split injection controller 2 may be configured to execute the cold start split injection control (S20) to satisfy the homogeneous injection (triple) regulation under the injection mode control (S30), execute the injection mode control (S30) to satisfy the malfunction diagnostic obligation regulation under the injection malfunction diagnostic control (S40), and perform the final malfunction determination of the cold start split injection in the split injection monitoring (S50). Accordingly, the split injection controller 2 may be configured to terminate the cold start split injection control in response to confirming that the injection malfunction diagnostic control (S40) is normal whereas terminating the cold start split injection control after the malfunction determination is performed in the split injection monitoring (S50) in response to confirming that the injection malfunction diagnostic control (S40) is abnormal, under the injection mode control (S30).

Specifically, the injection mode control (S30) may be implemented as performing a first injection mode (S30-1), performing a second injection mode (S30-2), performing a third injection mode (S30-3), and generating an injection operation detection value (S30-4). In particular, the injection mode control (S30) may be completed by performing the first injection mode (S30-1), determining the completion of performing the first injection mode (S30-1) and then performing the second injection mode (S30-2), and determining the completion of performing the second injection mode (S30-2) and then performing the third injection mode (S30-3).

Finally, the completion state of performing the third injection mode (S30-3) may be followed by the generating of the injection operation detection value (S30-4), and the generating of the injection operation detection value (S30-4) may include collecting the measurement results of the first, second, and third injection modes (S30-1, S30-2, S30-3). For example, the first injection mode (S30-1) is a primary (that is, first) cold start split injection.

Accordingly, the split injection controller 2 may be configured to terminate the first injection mode (S30-1) by measuring the opening time point and the opening angle of a primary injector by an operating current inflection point (e.g., Low Side of FIG. 2) and measuring the closing time point and the closing angle of the primary injector by an operating voltage inflection point (e.g., Low Side of FIG. 2) after the injector 1-2 injects once, calculating the difference between the closing time point of the primary injector and the opening time point of the primary injector as a primary injector operating time and then giving a count of 1 to the number of injector operation times.

For example, the second injection mode (S30-2) is a secondary (that is, second) cold start split injection following the termination of the first injection mode (S30-1). Accordingly, the split injection controller 2 may be configured to terminate the second injection mode (S30-2) by measuring the opening time point and the opening angle of a secondary injector by an operating current inflection point (e.g., Low Side of FIG. 2) and measuring the closing time point and the closing angle of the secondary injector by an operating voltage inflection point (e.g., Low Side of FIG. 2) after the injector 1-2 injects two times, calculating the difference between the closing time point of the secondary injector and the opening time point of the secondary injector as a secondary injector operating time and then adding a count of 1 to the number of injector operation times (that is, 2=the number of operating times (1)+1).

For example, the third injection mode (S30-3) is a tertiary (that is, third) cold start split injection following the termination of the second injection mode (S30-2). Accordingly, the split injection controller 2 may be configured to terminate the tertiary injection mode (S30-3) by measuring the opening time point and the opening angle of a tertiary injector by an operating current inflection point (e.g., Low Side of FIG. 2) and measuring the closing time point and the closing angle of the tertiary injector by an operating voltage inflection point (e.g., Low Side of FIG. 2) after the injector 1-2 injects three times, calculating the difference between the closing time point of the tertiary injector and the opening time point of the tertiary injector as a tertiary injector operating time and then adding a count of 1 to the number of injector operation times (that is, 3=the number of operating times (2)+1).

Further, the generating of the injection operation detection value (S30-4) may include acquiring the injector opening angle, the injector closing angle, the injector operating time, and the number of injector operation times from the results of performing the first, second, and third injection modes (S30-1, S30-2, S30-3).

Figure 3:
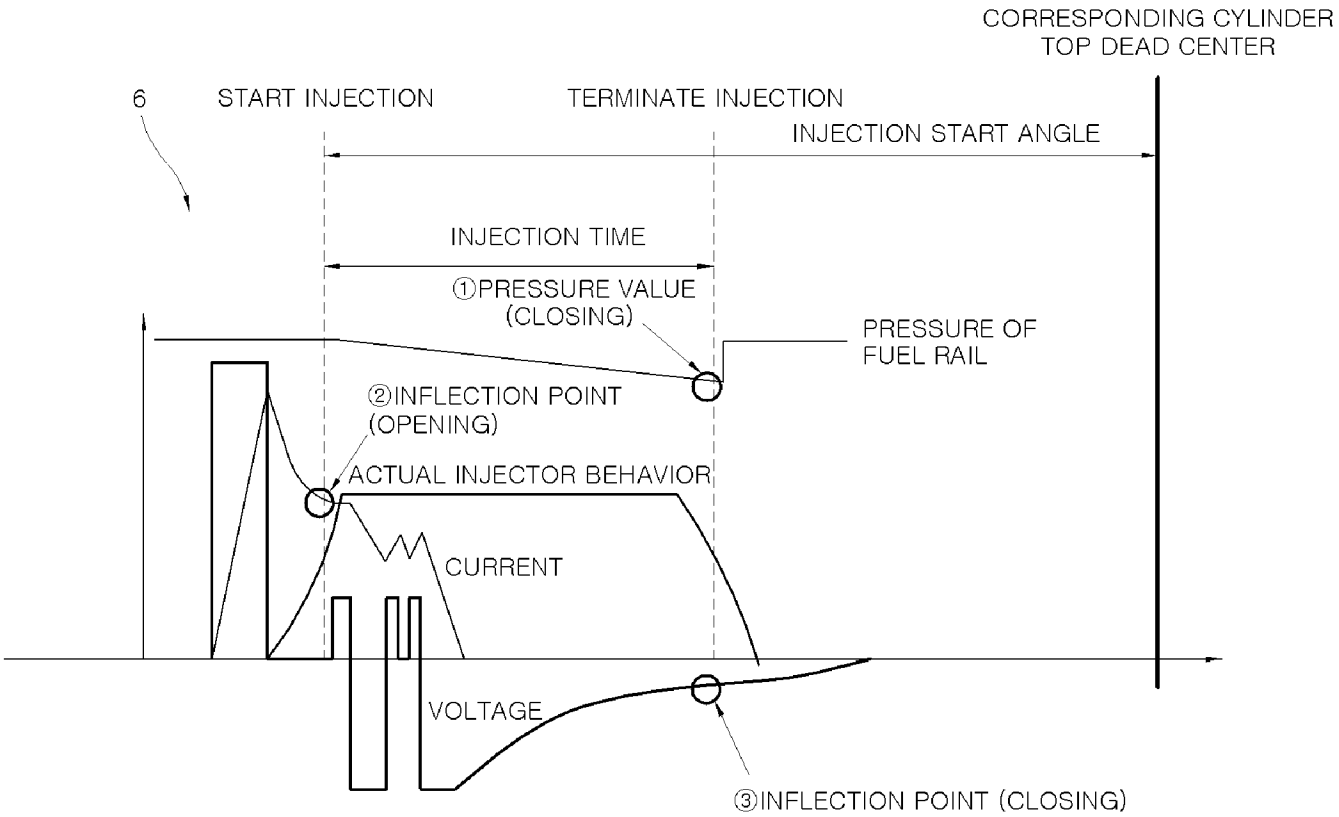
FIG. 3 is a diagram illustrating an example of an injection line diagram on the determination of the injector opening/closing, an injection start angle, and the number of injection times of a split injection controller according to an exemplary embodiment of the present disclosure.

Referring to FIG. 3, the injection line diagram illustrates the operating state of the injector 1-2 with respect to the number of injection times, the injector opening, the injector closing, and the injection start angle. For example, the number of injection times may be determined by measuring the injection time between the start of injection and the end of injection. Accordingly, each of the first, second, and third injection modes (S30-1, 30-2, 30-3) may be defined as the number of injection times of once, two times, and three times on "homogenous injection (triple) regulation" of the North American AECD document by measuring the corresponding cylinder injection time of the injector 1-2 for each cylinder 1-1A when the operation thereof is performed.

For example, the injector opening may be determined by measuring an inflection point generating time point [②] after applying the injector operating current; the injector closing may be determined by measuring an inflection point generating time point [③] during voltage reduction after the injector is opened; and the injection start angle is the angle between the start of the injector and the top dead center of the corresponding cylinder, and may be determined by measuring the angle at which the injector opening occurs forward with respect to the top dead center of the corresponding cylinder in which the fuel injection of the injector 1-2 is performed.

Figure 4:
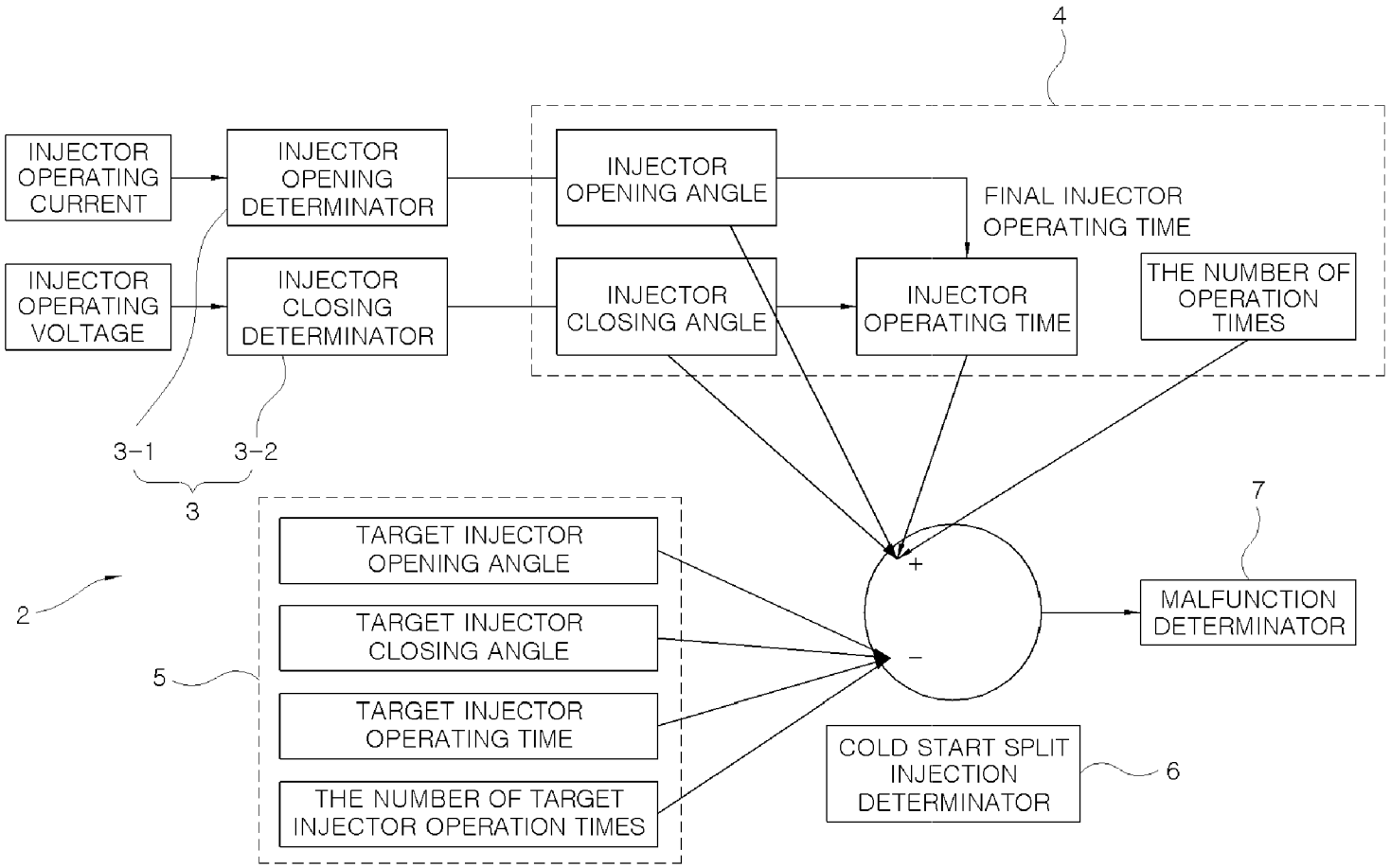
FIG. 4 is a diagram illustrating an operating state of the split injection controller upon the cold start split injection control according to an exemplary embodiment of the present disclosure.

Referring to FIG. 4, the split injection controller 2 may include the injector operation measurer 3 and the injector operation detector 4. For example, the injector operation measurer 3 may be classified into an injector opening determinator 3-1 configured to detect the operating current inflection point from the injector operating current flowing through the low side of the injector 1-2, and an injector closing determinator 3-2 configured to detect the operating voltage inflection point from the injector operating voltage flowing through the low side of the injector 1-2. Accordingly, the injector opening determinator 3-1 may be configured to measure the opening time points and the opening angles of the primary, secondary, and tertiary injectors, and the injector closing determinator 3-2 may be configured to measure the closing time points and the closing angles of the primary, secondary, and tertiary injectors.

For example, the injector operation detector 4 may be configured to generate, as the injection operation detection values, the injector opening angle, the injector closing angle, the injector operating time, and the number of injector operation times. In particular, the injector opening angle may be acquired based on an average value or an optimal value of the injector opening angles which are measured primarily, secondarily, and thirdly; the injector closing angle may be acquired based on an average value or an optimal value of the injector closing angles which are measured primarily, secondarily, and thirdly; the operating time of the injector may be acquired based on an average value of the injector operation times which are calculated primarily, secondarily, and thirdly or acquired based on an optimal value or based on a tertiary injector operating time, which is a final value. The number of injector operation times may be acquired as the number of injection times or the cumulative number of counts of the primary, secondary, and tertiary cold start split injections by measuring the corresponding cylinder injection time for each cylinder.

Referring back to FIGS. 1A, 1B and 1C, the injection malfunction diagnostic control (S40) may be performed by confirming an injection operation target value (S40-1) and performing an injection malfunction diagnostic (S40-2). Referring to FIG. 4, the split injection controller 2 may further include a cold start split injection determinator 6 connected to the injector operation detector 4 together with the injector operation target determinator 5.

For example, the injector operation target determinator 5 may be configured to provide the cold start split injection determinator 6 with a target injector opening angle, a target injector closing angle, a target injector operating time, and the target number of the injector operation times. Accordingly, the confirming of the injection operation target value (S40-1) may be performed by reading the target injector opening angle and time (S41), reading the target injector closing angle and time (S42), reading the target injector operating time (S43), and reading the target number of the injector operation times (S44).

For example, the cold start split injection determinator 6 may be configured to set, as operation values, the injector opening angle, the injector closing angle, the injector operating time, and the number of injector operation times which are provided by the injector operation detector 4, set, as verification values, the target injector opening time, the target injector opening angle, and the target number of the injector operation times among the target injector opening angle, the target injector opening time, the target injector closing angle, the target injector closing time, the target injector operating time, and the target number of the injector operation times which are provided by the injector operation target determinator 5, and diagnose the injection malfunction by using the operation values and the verification values.

Accordingly, the performing of the injection malfunction diagnostic (S40-2) may be performed by determining the injector operating time (S45), determining the injector opening angle (S46), and confirming the number of injector operation times (S47). For example, the determining of the injector operating time (S45) may include applying the following operating time verification expression, and the determining of the injector opening angle (S46) may include applying an opening angle verification expression.

$|(D-d)/D|<x?$ Operating time verification expression:

$|(E-e)/E|<y?$ Opening angle verification expression:

wherein "D" refers to the target injector operating time, "d" refers to the injector operating time, "|(D−d)/D|" refers to a dimensionless time index estimation value obtained by dividing a difference value (D−d) between the target injector operating time and the injector operating time by the target injector operating time, and "x" refers to a dimensionless time index threshold and is about 0.2.

In addition, "E" refers to the target injector opening angle, "e" refers to the injector opening angle, "|(E−e)/E|" refers to a dimensionless angle index estimation value obtained by dividing a difference value (E−e) between the target injector opening angle and the injector opening angle by the target injector opening angle, and "y" refers to a dimensionless angle index threshold and applies is about 0.2. In addition, "||" refers to an absolute value, "−" refers to a subtraction, "/" is a symbol indicating a division, and "<" refers to an inequality sign indicating the magnitude relationship between two values.

As a result, the split injection controller 2 may be configured to determine, as normality, the operating time which is applied to the first, second, and third injection modes (S30-1, S30-2, S30-3) when satisfying "|(the target injector operating time (D)−the injector operating time (d))/the target injector operating time (D)|<0.2(x)" and then may proceed to determining the injector opening angle (S46). In addition, the split injection controller 2 may be configured to determine, as normality, the opening angle which is applied to the first, second, and third injection modes (S30-1, S30-2, S30-3) when satisfying |the target injector opening angle (E)−the injector opening angle (e))/the target injector opening angle (E)|<0.2(y) and then may proceed to confirming the number of injector operation times (S47).

For example, the confirming of the number of injector operation times (S47) may include applying the number of operating times confirmation expression below. The number of operating times confirmation expression:

the number of injector operation times=$k$ wherein "the number of injector operation times" refers to the number of injector operation times which is confirmed in the first, second, and third injection modes (S30-1, S30-2, S30-3), "k" refers to the target number of the injector operation times, and "=" refers to an equality sign indicating that the two values are equal.

As a result, the split injection controller 2 may be configured to determine that all of the first, second, and third injection modes (S30-1, S30-2, S30-3) have been performed normally when the number of injector operation times and the target number of the injector operation times are equal to each other as three and then terminates the procedure of the split injection control (S20) upon cold start.

Referring back to FIGS. 1A, 1B and 1C, the split injection monitoring (S50) may include monitoring the results of the determining of the injector operating time (S45), the determining of the injector opening angle (S46), and the confirming of the number of injector operation times (S47) of the performing of the injection malfunction diagnostic (S40-2), and may include performing the malfunction determination of the cold start split injection control (S20) based on the monitoring results.

For example, the split injection controller 2 may be configured to set, as abnormality, an operating time which does not satisfy "|(the target injector operating time (D)−the injector operating time (d))/the target injector operating time (D)|<0.2(x)" to perform the malfunction determination of the first, second, and third injection modes (S30-1, S30-2, S30-3), sets, as abnormality, an opening angle which does not satisfy |(the target injector opening angle (E)−the injector opening angle (e))/the target injector opening angle (E)|<0.2(y) to perform the malfunction determination of the first, second, and third injection modes (S30-1, S30-2, S30-3), and perform the malfunction determination of the first, second, and third injection modes (S30-1, S30-2, S30-3) when the number of injector operation times and the target number of the injector operation times are not equal to each other as three, through the split injection monitoring (S50) and then may be configured to terminate the procedure of the split injection control (S20) upon cold start.

Referring to FIG. 4, the split injection controller 2 may include a malfunction determinator 7 connected to the cold start split injection determinator 6. For example, the malfunction determinator 7 may be configured to generate an injection bad signal with respect to the malfunction determination which is output by the cold start split injection determinator 6, and the injection malfunction signal may turn on the engine warning light 1-6 of FIG. 2 as a warning message for the driver.

Figure 5:
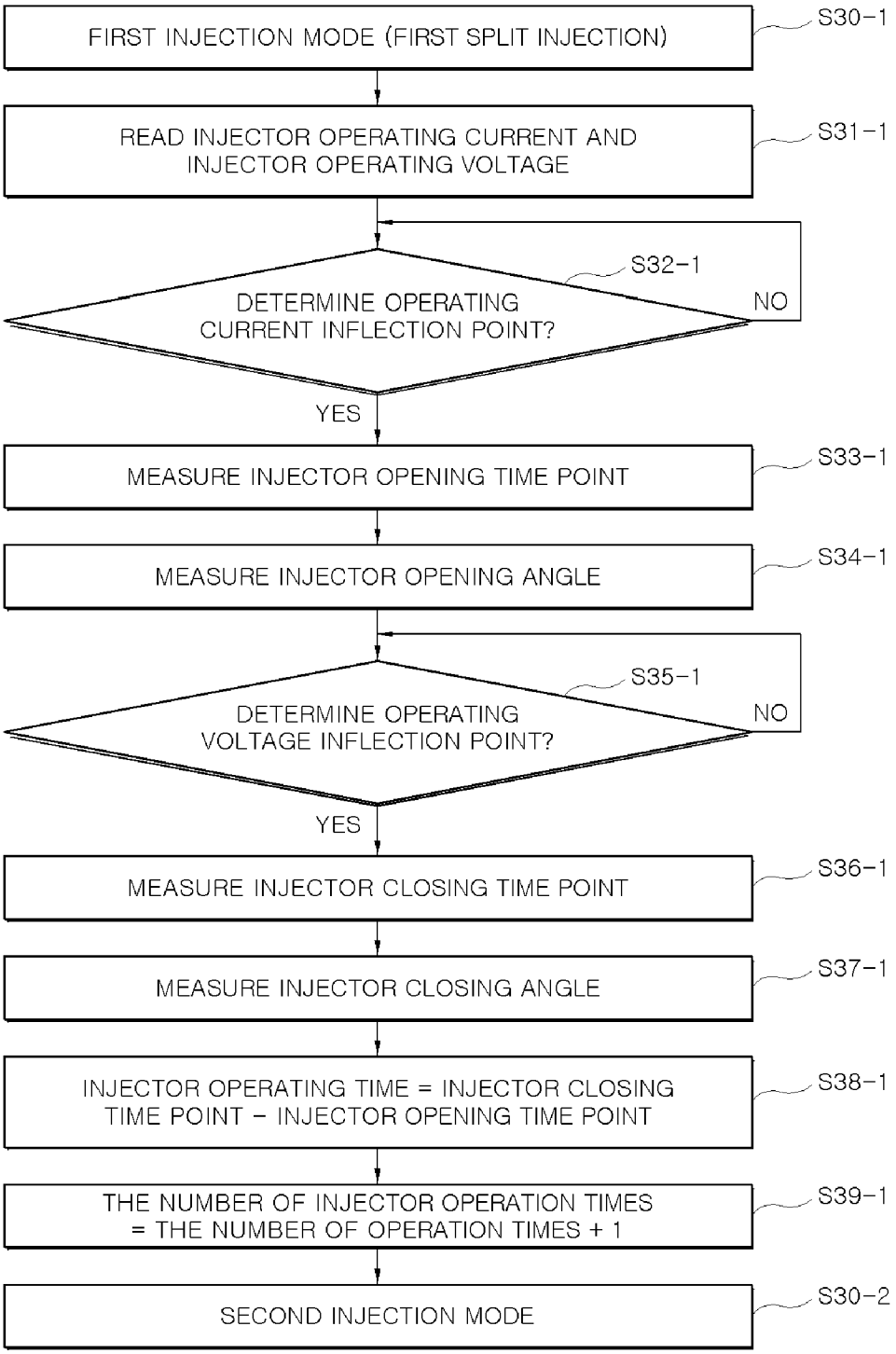
FIG. 5 is a flowchart of executing a first injection mode, which is the first number of times in the injection mode control according to an exemplary embodiment of the present disclosure.
Figure 6:
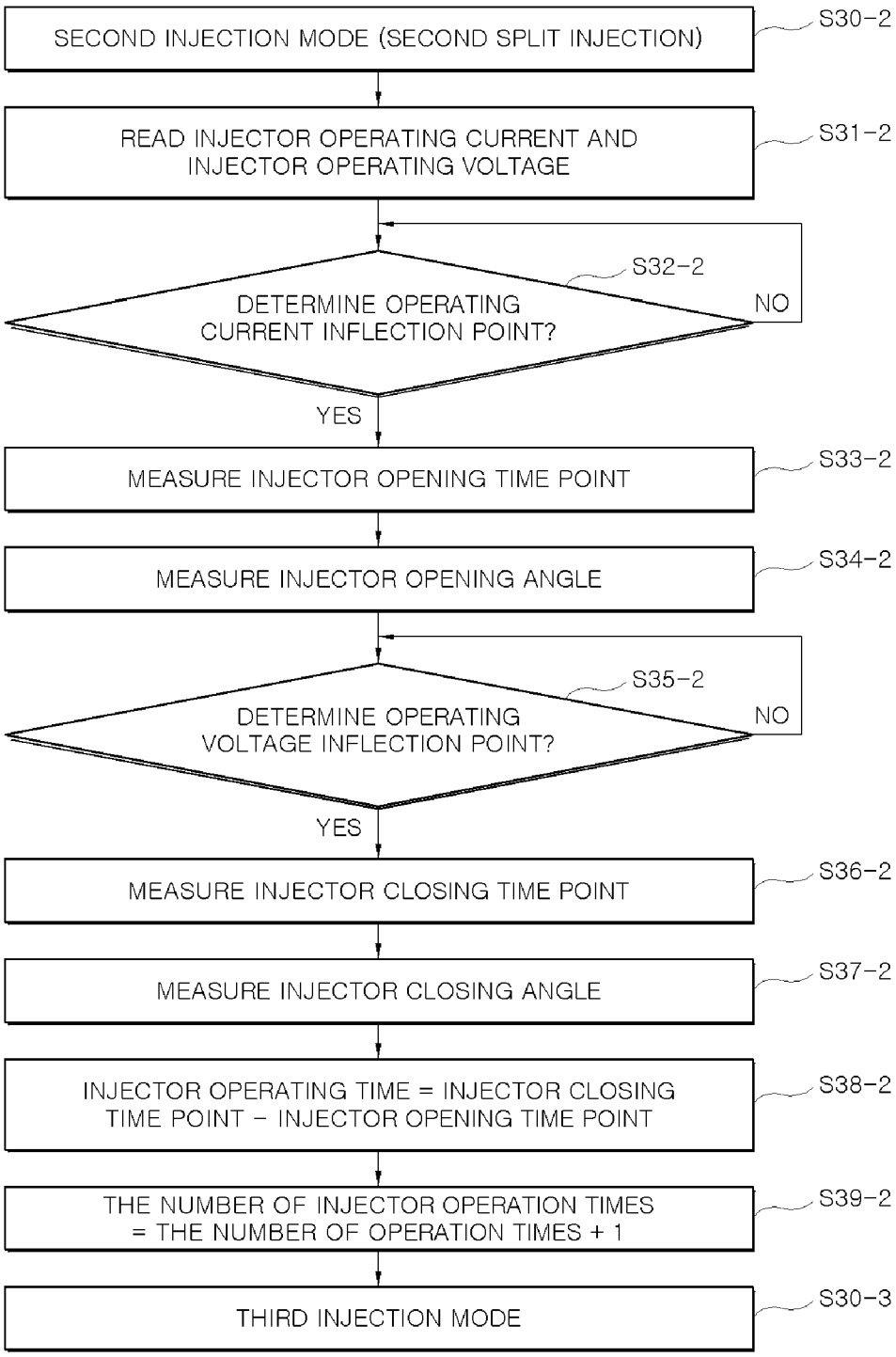
FIG. 6 is a flowchart of executing a second injection mode, which is the second number of times in the injection mode control according to an exemplary embodiment of the present disclosure.
Figure 7:
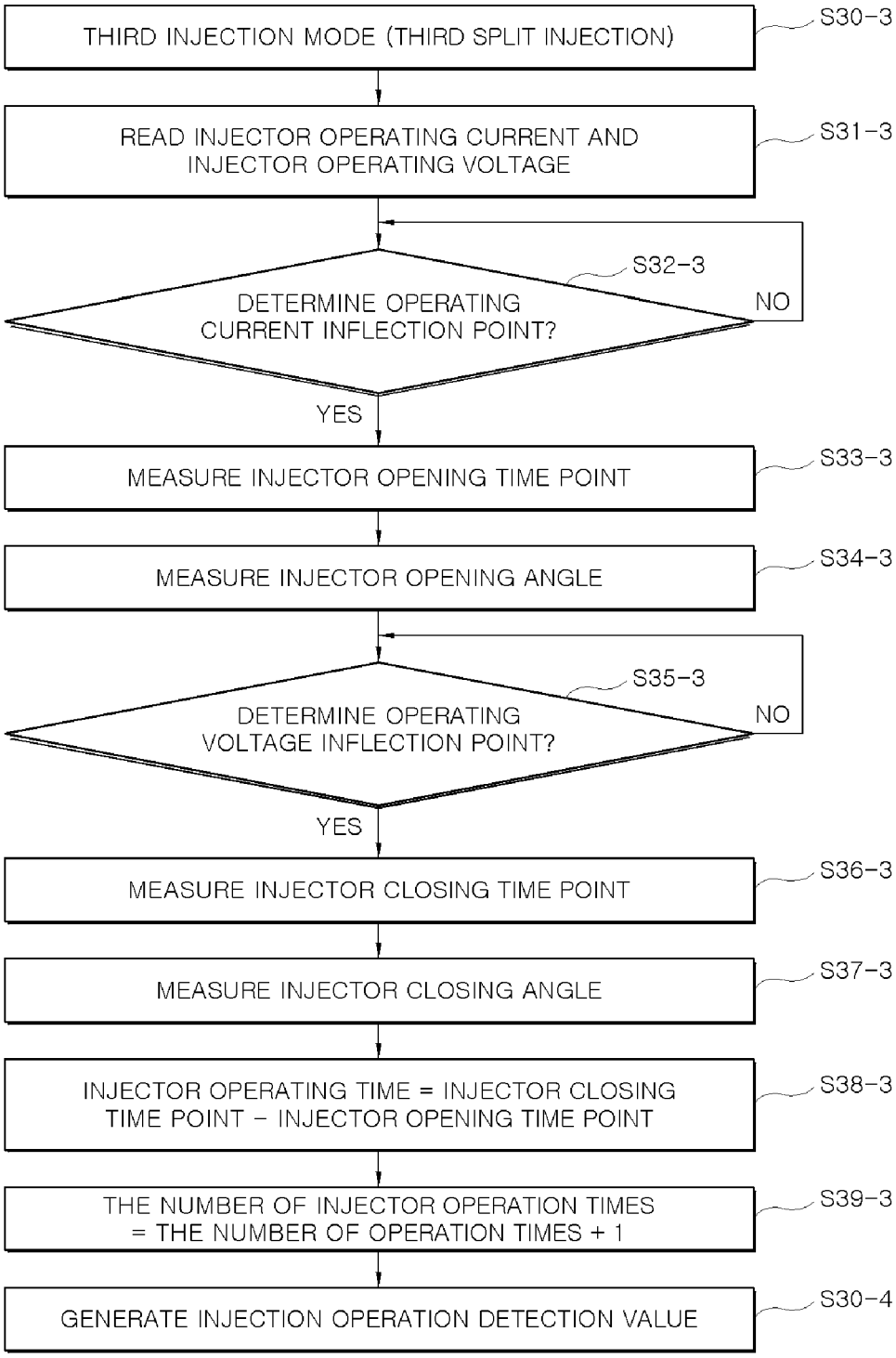
FIG. 7 is a flowchart of executing a third injection mode, which is the third number of times in the injection mode control according to an exemplary embodiment of the present disclosure.

Meanwhile, FIGS. 5 to 7 specifically illustrate an injection mode procedure which is applied to each of the first, second, and third injection mode controls (S30). In particular, the injection mode procedure may be partially omitted, partially changed in order, or partially integrated in order when the generating of the injection operation detection value (S30-4) may be obtained equally.

Referring to FIG. 5, the first injection mode (S30-1) may be performed by detecting the injector operating current and operating voltage based on the fuel injection start (S31-1), determining the operating current inflection point from the injector operating current (S32-1), measuring the injector opening time point (S33-1), measuring the injector opening angle (S34-1), determining the operating voltage inflection point from the injector operating voltage (S35-1), measuring the injector closing time point based on the fuel injection termination (S36-1), measuring the injector closing angle based on the fuel injection termination (S37-1), calculating the injector operating time using the difference between the injector closing time point and the injector opening time point (S38-1), and confirming the number of injector operation times by giving a count (S39-1).

Referring to FIG. 6, the second injection mode (S30-2) may be performed by detecting the injector operating current and operating voltage based on the fuel injection start (S31-2), determining the operating current inflection point from the injector operating current (S32-2), measuring the injector opening time point (S33-2), measuring the injector opening angle (S34-2), determining the operating voltage inflection point from the injector operating voltage (S35-2), measuring the injector closing time point based on the fuel injection termination (S36-2), measuring the injector closing angle based on the fuel injection termination (S37-2), calculating the injector operating time using the difference between the injector closing time point and the injector opening time point (S38-2), and confirming the number of injector operation times by increasing a count (S39-2).

Referring to FIG. 7, the third injection mode (S30-3) may be performed by detecting the injector operating current and operating voltage based on the fuel injection start (S31-3), determining the operating current inflection point from the injector operating current (S32-3), measuring the injector opening time point (S33-3), measuring the injector opening angle (S34-3), determining the operating voltage inflection point from the injector operating voltage (S35-3), measuring the injector closing time point based on the fuel injection termination (S36-3), measuring the injector closing angle based on the fuel injection termination (S37-3), calculating the injector operating time using the difference between the injector closing time point and the injector opening time point (S38-3), and confirming the number of injector operation times by increasing a count (S39-3).

As described above, the injection mode procedure which is applied to each of the first, second, and third injection mode controls (S30) may be performed by the same steps except that there is the difference between only specific numerical values of the injector opening angles, the injector closing angles, the injector operation times, and the number of injector operation times which are acquired, as operation values, from the results.

As described above, in the cold start split injection control method which is applied to the engine system 1 according to the present exemplary embodiment, the split injection controller 2 may be configured to measure, as the operation values, any one or more among the injector opening angle, the injector operating time, and the number of injector operation times by performing the cold start split injection by the triple split injection operation of the injector 1-2 based on the cold start operation of the engine system 1, and maybe configured to apply the values to the malfunction determination of the cold start split injection by reading, as the verification values, any one or more among the target injector opening angle, the target injector closing angle, the target injector operating time, and the number of target injector operation times, thereby meeting the CARB OBD-2 section 1968.2 specifying the triple fuel injection and the North American AECD document required items specifying the cold start control malfunction diagnostic together, and particularly, preemptively responding to tightening the emission regulations by extending the split injection control to the cold start region.

What is claimed is:

1. A cold start split injection control method, comprising:

performing, by a split injection controller, an injection mode control which performs a cold start split injection by an operation of an injector, wherein the split injection controller determines cold start conditions of an engine system; and performing, by the split injection controller, an injection malfunction diagnostic control which performs an injection malfunction diagnostic with any one or more among an injector opening angle, an injector operating time, and the number of injector operation times measured using the fuel injection of the injector;

wherein the injection malfunction diagnostic control is performed by:

confirming a target injector opening angle, a target injector closing angle, a target injector operating time, and the number of target injector operation times;

determining a time verification of the injector operating time with a target injector operating time and the injector operating time;

determining an angle verification of the injector opening angle with the injector opening angle and the target injector opening angle; and confirming the number of times of the number of injector operation times with the target number of the injector operation times and the number of injector operation times.

2. The method of claim 1, wherein the cold start conditions apply a coolant temperature and an engine revolution per minute (RPM), and wherein the cold start condition determination is performed based on the coolant temperature initially followed by the engine RPM.

3. The method of claim 2, wherein the coolant temperature is applied as a determination condition by setting a setting coolant temperature to 56° C.

4. The method of claim 2, wherein the engine RPM is applied as a determination condition by setting a setting engine RPM region to 700 to 960 revolutions per minute (RPM).

5. The method of claim 1, wherein the injection mode control includes generating, as injection operation detection values, any one or more among the injector opening angle, an injector closing angle, the injector operating time, and the number of injector operation times by performing the cold start split injection.

6. The method of claim 1, wherein the injection mode control is performed by:

determining operating current inflection points by detecting injector operating currents based on a fuel injection start;

measuring an injector opening time point and the injector opening angle;

determining operating voltage inflection points by detecting injector operating voltages based on the fuel injection start;

measuring an injector closing time point and an injector closing angle based on a fuel injection termination;

calculating the injector operating time; and counting the number of injector operation times.

7. The method of claim 6, wherein the injector operating time is calculated by the difference between the injector closing time point and the injector opening time point.

8. The method of claim 6, wherein the injection mode control is performed by a first injection mode, a second injection mode, and a third injection mode in which the number of injector operation times is increased by a count of 1.

9. The method of claim 1, wherein a time index estimation value, which is obtained by dividing a difference value of the target injector operating time and the injector operating time by the target injector operating time, and a time index threshold are applied to the determining of the time verification.

10. The method of claim 9, wherein the time index threshold is 0.2.

11. The method of claim 9, wherein the cold start split injection is determined as malfunction in response to determining that the time index estimation value is less than the time index threshold.

12. The method of claim 1, wherein an angle index estimation value, which is obtained by dividing a difference value of the target injector opening angle and the injector opening angle by the target injector opening angle, and an angle index threshold are applied to the determining of the angle verification.

13. The method of claim 12, wherein the angle index threshold is 0.2.

14. The method of claim 12, wherein the cold start split injection is determined as malfunction in response to determining that the angle index estimation value is less than the angle index threshold.

15. The method of claim 1, wherein the confirming of the number of times includes applying the numerical identity between the target number of the injector operation times and the number of injector operation times, and the cold start split injection is determined as malfunction in response to determining that the numerical values are not the same.

16. The method of claim 15, wherein the numerical identity is 3.

* * * * *